United States Patent [19]

Hoshii

[11] 4,448,104

[45] May 15, 1984

[54] ELECTRONIC APPARATUS HAVING A TONE GENERATING FUNCTION

[75] Inventor: Toshifumi Hoshii, Tokyo, Japan

[73] Assignee: Casio Computer Co., Ltd., Tokyo, Japan

[21] Appl. No.: 540,699

[22] Filed: Oct. 11, 1983

Related U.S. Application Data

[63] Continuation of Ser. No. 331,173, Dec. 16, 1981, abandoned.

[30] Foreign Application Priority Data

Dec. 24, 1980 [JP] Japan ..... 55-181920

[51] Int. Cl.[3] ..... G10H 1/26; G10H 7/00

[52] U.S. Cl. ..... 84/1.01; 84/1.03; 84/1.28

[58] Field of Search ..... 84/1.01, 1.03, 1.28, 84/DIG. 12, DIG. 29

[56] References Cited

U.S. PATENT DOCUMENTS

| | | | |
|---|---|---|---|
| 3,878,750 | 4/1975 | Kapps . | |
| 3,890,871 | 6/1975 | Oberheim | 84/1.01 |
| 3,955,459 | 5/1976 | Mochida et al. | 84/1.01 |
| 4,022,097 | 5/1977 | Strangio | 84/1.03 |
| 4,129,055 | 12/1978 | Whittington et al. | 84/1.01 |
| 4,160,399 | 7/1979 | Deutsch . | |
| 4,177,708 | 12/1979 | Pinz et al. | 84/1.28 |
| 4,202,235 | 5/1980 | Namiki et al. | 84/1.01 |
| 4,250,787 | 2/1981 | Segan et al. | 84/1.01 |
| 4,296,664 | 10/1981 | Woolbright | 84/1.03 |
| 4,326,276 | 4/1982 | Scott, Jr. | 84/1.01 X |

FOREIGN PATENT DOCUMENTS

| | | |
|---|---|---|
| 2728513 | 1/1978 | Fed. Rep. of Germany . |
| 2808285 | 9/1978 | Fed. Rep. of Germany . |
| 55-83094 | 6/1980 | Japan . |
| 1566663 | 5/1980 | United Kingdom . |
| 2070311 | 3/1981 | United Kingdom . |
| 2061593 | 5/1981 | United Kingdom . |
| 2066549 | 7/1981 | United Kingdom . |

OTHER PUBLICATIONS

"Elektor" Magazine Jul./Aug. 1979, p. 96 256-Note Sequencer.

*Primary Examiner*—S. J. Witkowski

*Attorney, Agent, or Firm*—Frishauf, Holtz, Goodman and Woodward

[57] ABSTRACT

When a key among ten keys or function keys in a keyboard section is operated with a mode selection switch in a key input section set in a recording position, the note data corresponding to the operated key, flag data and tone duration data corresponding to that note data are stored as one-key play note data in a note memory. When a one-key play key is operated in a timed relation to a given rhythm after clearing an address counter in the aforementioned state, musical sound is generated according to the note data stored in the note memory, and at the same time note data is stored again together with flag data for auto play and tone duration data in the note memory.

9 Claims, 10 Drawing Figures

ELECTRONIC APPARATUS HAVING A TONE GENERATING FUNCTION

This application is a continuation of application Ser. No. 331,173, filed Dec. 16, 1981, and now abandoned.

BACKGROUND OF THE INVENTION

This invention relates to electronic apparatus having a tone generating function and, more particularly, to an electronic apparatus having an automatic performance function of progressively producing a series of tones.

Recently, small size electronic apparatus having a tone generating function of effecting automatic performance of a simple melody or permitting performance of a simple melody using ten keys and function keys, for instance an electronic desk-top calculator, have been developed. Further, the tonal character of the generated musical sound is controlled through envelope control of ADSR (attack, decay, sustain and release) portions.

In one type of envelope control in a prior art small size electronic apparatus for performance of a melody with the operation of note keys, constant envelope control is always made irrespective of the "on" and "off" periods of keys. According to this prior art system, however, the tonal character of the generated musical sound is always constant, which is undesired from the musical standpoint. In another system, the envelope control is effected by taking the lengths of the "on" and "off" periods of keys into consideration. In this system, rich and satisfactory tonal characters are available for imparting them to the generated musical sound. On the demerit side, however, when permitting automatic performance of a melody with this system the "on" and "off" periods have to be stored as independent data in the tone memory. Therefore, at least double the storage capacity of the tone memory compared to the first-mentioned system is necessary.

Still further, there have recently been developed small size electronic musical instruments having a so-called one-key play function, in which only note data of a melody is stored in a memory and is read out progressively therefrom every time a particular key is operated, with tone duration data being added to each read-out note data to produce musical sounds, and also small size electronic musical instruments of so-called auto play function, in which both note data and tone duration data of a melody are stored in a memory and are progressively and automatically read out for melody performance.

As the method of coupling note data and tone duration data to a memory in a small size electronic musical instrument having the aforementioned auto play function, there have been proposed one, in which note data and tone duration data are keyed in by actually playing note keys, and one, in which note keys and tone duration keys are alternately operated to alternately couple note data and tone duration data. In the first-mentioned method, however, melody has to be actually performed, and this keying method is difficult for beginners. In the second method, it is necessary to provide note keys, and this increases the size of the instrument.

SUMMARY OF THE INVENTION

An object of the invention is to provide an electronic apparatus having a tone generating function, which has a one-key play function and an auto play function and permits musical sound satisfactory from the musical standpoint to be readily produced with a comparatively simple circuit construction.

According to the invention, this object is attained by an electronic apparatus having a tone generating function comprising key input means including input keys for coupling at least desired tone information by keying operation and first and second read keys for reading out the tone information having been coupled, memory means for storing note data and tone duration data relevant to the note data, this data being provided as the tone information from the key input means, control means for progressively reading out at least the note data from the memory means every time the first read key in the key input means is operated and writing the tone duration data relevant to the read-out note data in the memory means according to the period of operation of the first read key, and automatic read-out means for continuously reading out the note data and relevant tone duration data from the memory means in response to the operation of the second read key in the key input means.

DETAILED DESCRIPTION OF THE PREFERRED EMBODIMENT

Figure 1:
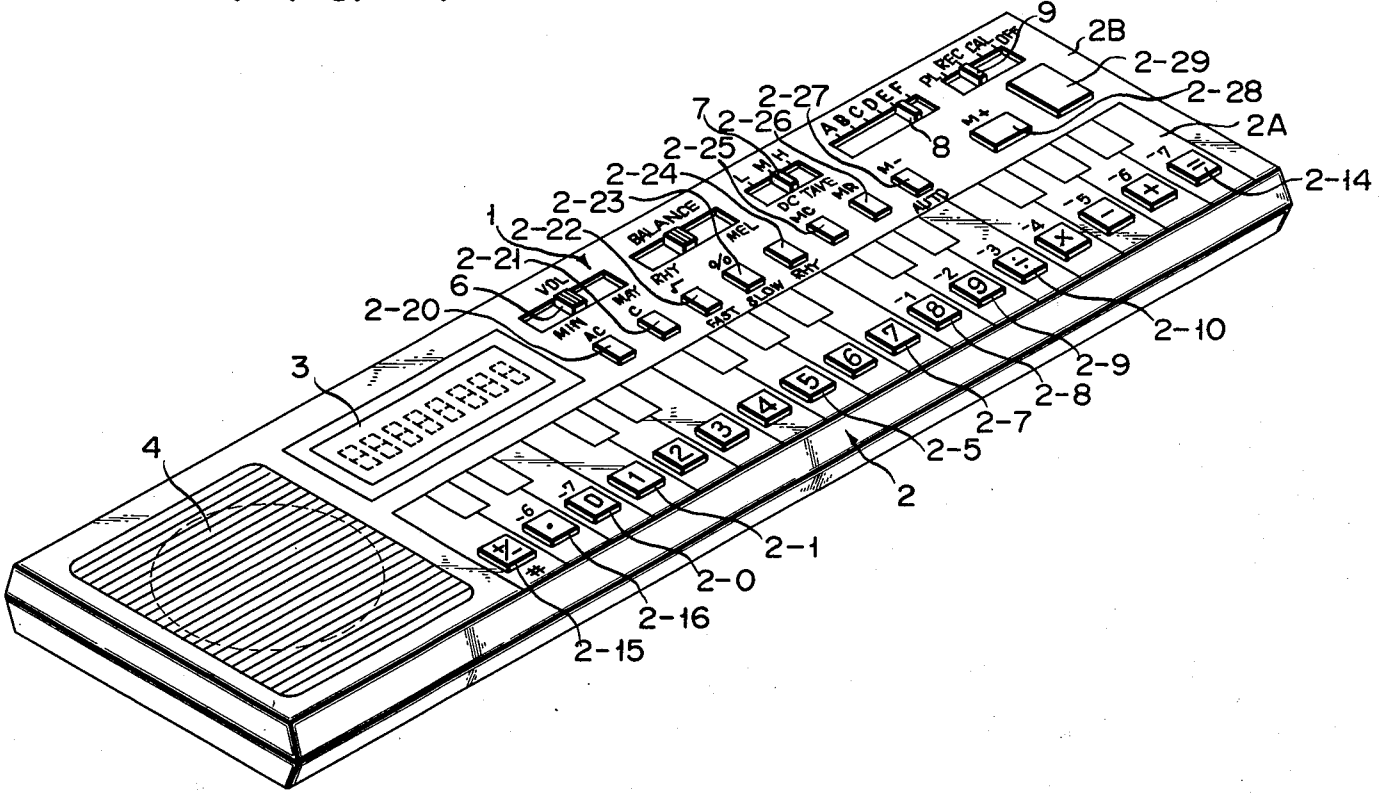
FIG. 1 is a perspective view showing an embodiment of the invention applied to a small size electronic calculator.

Now, one embodiment of the invention applied to a small size electronic calculator having a tone generating function will be described with reference to the drawings. Referring to FIG. 1, on a case 1 of a small size electronic calculator, a key input section having various keys, a display section 3 and a loudspeaker 4 are provided. Inside the case 1, LSI parts constituting various circuits, a battery, etc. are provided in a keyboard section 2A and an operating section 2B. The keyboard section 2 includes ten keys 2-0, 2-1, . . . , 2-9 for coupling numerals "0" to "9", function keys 2-10, 2-11, . . . , 2-15 for coupling calculation instructions "±" "÷", "×", "−", "+" and "=", and a decimal point key 2-16. On the operating section 2B, function keys 2-20 to 2-29 for coupling instructions "AC", "√", "%", "MR", "M−" and "M+" are provided. In this embodiment, 17 keys 2-0 to 2-16 on the keyboard section 2A are also used as note specification keys (or note keys) for specifying notes A3 to B5. Further, the "AC" key 2-20 and "C" key 2-21 on the operating section 2B are also used as melody performance keys, with the former as a clear key for clearing an address counter to be described later and the latter as a key for correcting note data and tone duration data supplied to a note memory to be described later. Further, the keys 2-22 and 2-23 are used as keys for rhythm tempo-up and -down. The "M−" key 2-27 is used together with the "AC" key 2-20 for providing an auto play start instruction. Further, the "M+" key 2-28 is used as a one-key play key. Further, a key 2-29 is used as one-key play key having entirely the same function as the "M−" key 2-28. By the term "one-key play" is meant a function of progressively reading out a series of melody note data for performance for every operation of the "M+" key 2-28 or one-key play key 2-29. Designated at 6, 7, 8 and 9 in FIG. 1 are, respectively, a volume switch, an octave shift switch, a tone specification switch and a mode selection switch. The mode selection switch has switch positions PL, REC, CAL and OFF, respectively, specifying a play mode, a recording mode, a calculation mode and power off. The tone specification has positions A to F. In its position F, the A, D, S and R (attack, decay, sustain and release) portions of an envelope can be set, and also tone can be set in this position at the time of the one-key play and auto play.

Of the aforementioned 17 note keys, the key 2-15 is a semi-tone key, the keys 2-1 and 2-7 are keys for specifying respective notes A3 and B3 in the third octave, the keys 2-1 and 2-7 are keys for specifying the notes C4 and B4 for the fourth octave, and the keys 2-8 to 2-14 are keys for specifying notes C4 to B5 in the fifth octave. In the keying operation for producing a semi-tone, for instance a note A3#, the two keys, i.e., the keys 2-15 and 2-16 are operated in the mentioned order. To indicate the key arrangement of the keys 2-15, 2-16, . . . , 2-14 for the aforementioned notes A3 to B5, a key arrangement pattern in the keyboard instrument is printed on the keyboard section 2A as shown in FIG. 1. Further, the notes C to B are made to correspond to respective numerals 1 to 7. For the third octave or fifth octave, a bar (—) is given at right bottom or right top of the aforementioned symbol to indicate that the note is in the third or fifth octave. For the fourth octave, no bar is given, indicating that the note is in the fourth octave.

Figure 2:
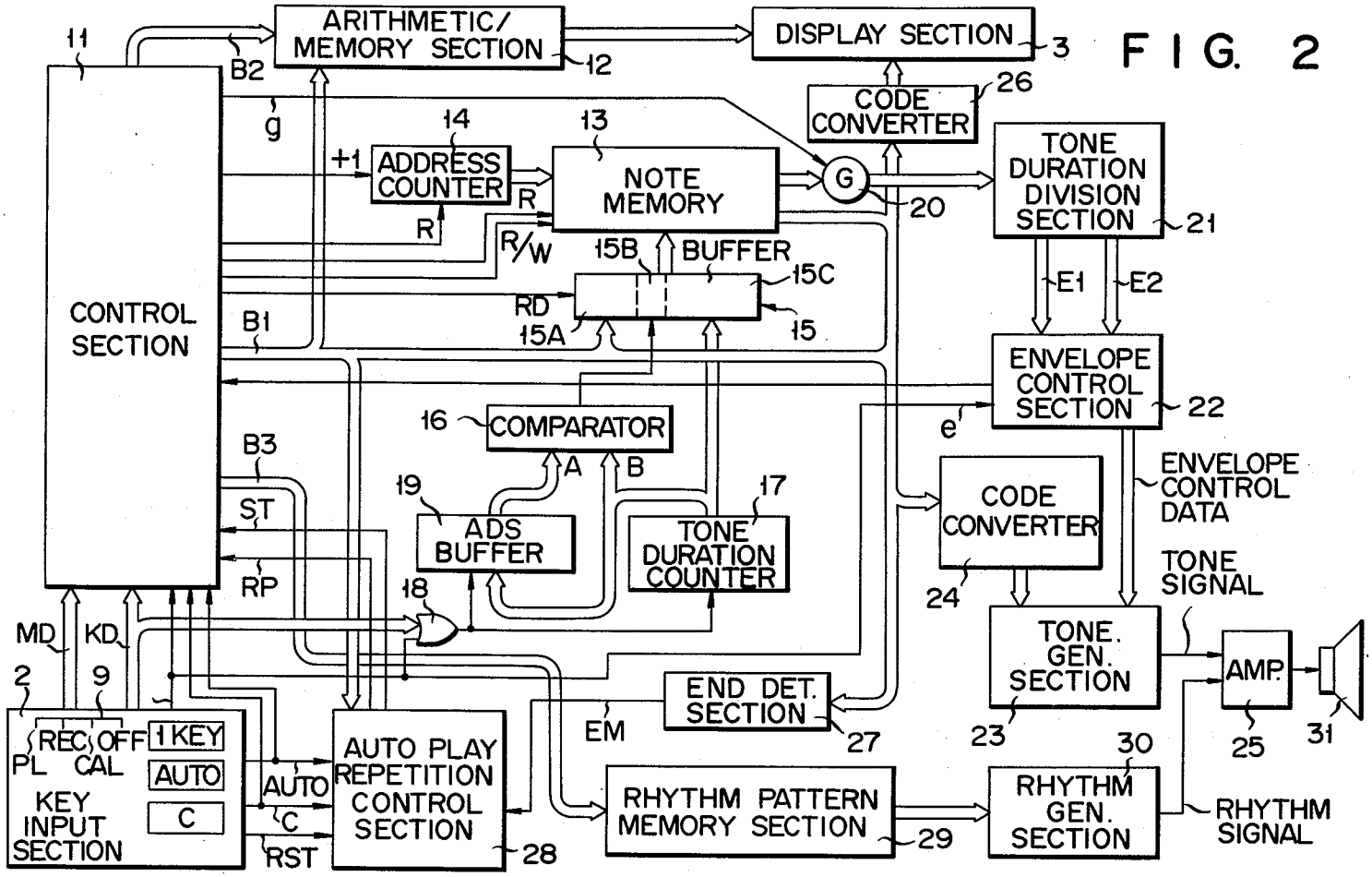
FIG. 2 shows a block diagram showing the internal construction of the calculator shown in FIG. 1.

The circuit construction will now be described with reference to FIG. 2. The output of the mode selection switch 9 on the key input section 2 is fed as signal MD while the outputs of various other keys as signal KD to a control section 11. The aforementioned one-play key 2-28 and one-key play key 2-29 on the key input section 2 shown in FIG. 2 are both shown as "ONE-KEY", and the output thereof is shown as signal ONE-KEY. The keys 2-20 and 20-27 constitute an auto play start instruction key shown as "AUTO", and the output thereof (i.e., start instruction) is shown as signal AUTO. Further, the output of the "C" key 2-21 is shown as signal C. The signals ONE-KEY, AUTO and C mentioned above are all fed to the control section 11. Further, the output of the "C" key 2-21 is shown as signal C. The signals ONE-KEY, AUTO and C mentioned above are all fed to the control section 11. When the mode selection switch 9 is switched from the position "OFF" to another position to turn on power, a reset signal RST is provided, whereupon individual circuits are initiated.

In the control section 11, microprograms for controlling the operation of the small size electronic computor in various modes are stored. When the aforementioned signal MD is fed to it, the section 11 discriminates the preset mode and provides various microinstructions corresponding to the discriminated mode. Also, when signals KD and ONE-KEY are fed to it, it provides microinstructions by discriminating the kinds of operated keys.

An arithmetic memory section 12 consists of an operational circuit and a RAM (random access memory). When numerical data is given through a bus line B1, and instruction data through the bus line B2, as predetermined instructions from the control section 11, the section 12 executes various operations such as four-role operations, logic operations and judgement operations. The operation result data is stored in an inner RAM or the like or given to other circuits, and data to be displayed is supplied to a display section 3 for display thereon.

A note memory 13 consists of a RAM, in which a series of note data for a piece of music, tone duration data and flag data to be described later are stored. The note memory 13 is address specified for the areas for storing the aforementioned individual data by address data provided from an address counter 14. Also, data reading and writing operations are controlled by the read/write control signal R/W provided from the control section 11. More particularly, when writing the aforementioned individual data in the note memory 13, the mode selection switch 9 is switched to the position REC to set a write mode. Then, when the "MC" key 2-25 is operated, the signal R provided from the control section 11 is cleared by the note memory 13, while the address counter 14 is reset. Subsequently, note specification keys 2-0 to 2-16 for notes A3 to B5 are progressively operated according to a given melody. At this time, for every operation of note specification key a "+1" signal is provided from the control section 11 to the address counter 14 to renew the address data, while also the note data for the operated note specification keys are successively provided from the control section 11 and fed to a buffer 15. Also, flag data and interval data are successively provided from a comparator 16 and a tone duration counter 17, respectively, to be buffer 15. As a result, the aforementioned note data, flag data and tone duration data are successively written through the buffer 15 into the note memory 13. This writing operation is in the case of obtaining note data for one-key play. According to the invention, for obtaining accurate flag data and tone duration data for auto play, following the aforementioned writing operation the "AC" key 2-20 is operated to reset the address counter 14, and the key 2-28 for one-key play or one-key play key 2-29 is operated according to a rhythm in a rhythm generating section to be described later. In this case, whenever the key 2-28 or one-key play key 2-29 is operated, a "+1" signal is provided from the control section 11 to the address counter 14 to renew the address data. Also, accurate flag data and tone duration data are produced by the comparator circuit 16 and tone duration counter 17, respectively, and fed to the buffer 15. The note data written in the note memory 13 in the previous writing operation, is this time progressively read out from the note memory 13 and written through the buffer 15 into the relevant area of the note memory 13 again while also being coupled through a code converter 24 to be described later to a tone generating section 23. Thus, the production of data for auto play as mentioned above is executed while melody is performed in one-key play mode. When performing melody by reading out from the note memory 13, the data for one-key play written in the note memory 13 in the aforementioned method or data for auto play, the play mode is first set by switching the mode selection switch 9 to the position PL. Then, in the case of rhythm performance of one-key play the "AC" key 2-20 is first operated to reset the address counter 14, and then the aforementioned key 2-28 or one-key play key 2-29 is operated to read out note data from the note memory 13. Meanwhile, in the rhythm performance of auto play, the keys 2-20 and 2-27 are continuously operated. In consequence, after the address counter 14 is reset, its content is automatically progressively incremented by +1's, whereby sets of note data, flag data and tone duration data are read out one set after another from the note memory 13. Also, in the case of the writing operation in the auto play, after the writing of all data with respect to each note of melody is ended, the keys 2-20 and 2-28 and one-key play key 2-29 are operated to write a section code. This is done according to the invention to permit performance of a melody written in the note memory 13 for one piece of music repeatedly for a number of times specified by successive operation of ten keys 2-0 to 2-16 and keys 2-21 and 2-27.

Figure 4A:
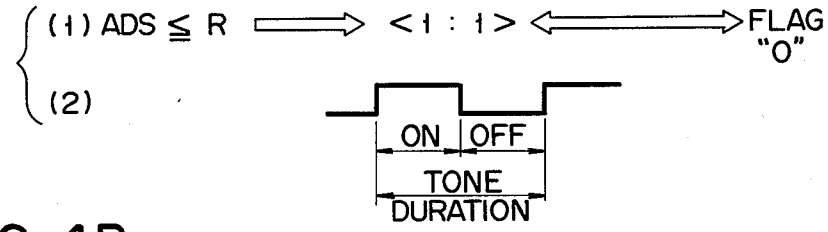
FIGS. 4A and 4B are views showing the relation between the "on"-to-"off" period ratio of tone duration data and flag data.
Figure 4B:
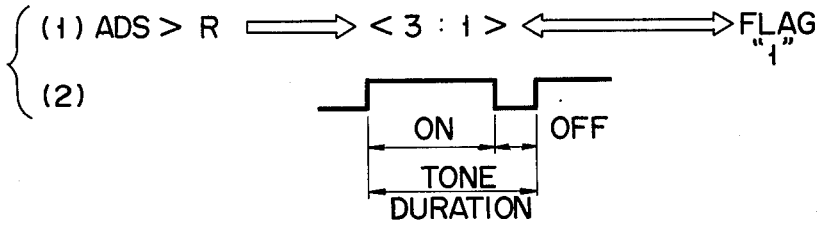

Now, the note data, flag data and tone duration data will be described. The note data is a signal, which is provided from the control section 11 when operating note specification keys 2-0 to 2-16 for the notes A3 to B5 in the recording mode or performance mode as mentioned above, and the notes A3 to B5 are made to correspond to note data 1 to 27. The flag data is a data absolutely defined as a result of comparison of the "on" and "off" periods of the aforementioned note specification keys 2-0 to 2-16 (the "off" period referring to a period from the turning-off of a note specification key having been operated until the key-on of the next note specification key. If the "on" period is shorter than or equal to the "off" period, the flag data is "0", and if the former period is longer than the latter period, the flag data is "1" (see FIGS. 4A and 4B). The tone duration data is a data obtained as a result of the counting of the key operation period of each one-key play key such as the aforementioned note specification keys 2-0 to 2-16 or 2-18 in an interval counter 17 to be described later.

Figure 3:
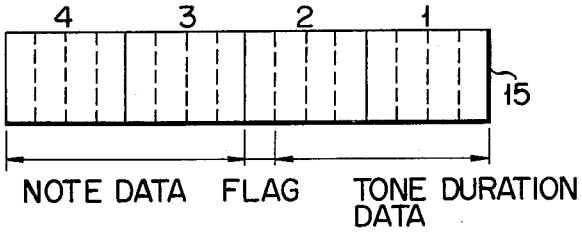
FIG. 3 is a view showing data storage locations of a buffer shown in FIG. 2.

When read signal RD is provided from the control section 11, the aforementioned buffer 15 temporarily memorizes the aforementioned note data, flag data and tone duration data. As shown in FIG. 3, the buffer 15 has a capacity of four digits (one digit consisting of 4 bits), and the aforementioned note data, flag data and tone duration data are stored in its respective areas 15A (8 bits), 15B (1 bit) and 15C (7 bits).

Now, the circuit for producing the aforementioned flag data and tone duration data will be described. The signals KD and ONE-KEY that are provided from the keying section 2 at the time of the operation of the aforementioned note specification keys 2-0 to 2-16 and one-key play keys 2-28 and 2-29 are coupled through an OR gate 18 to a tone duration counter 17 and ADS buffer 19. The tone duration counter 17 is a counter for counting a given frequency signal provided from a timing signal producing circuit not shown, and it is reset to start counting operation afresh every time the output of the OR gate 18 is inverted from "0" to "1". The counter data of the tone duration counter 17 is given as tone duration data to an area 15C of the buffer 15 and also to the input terminal of a comparator circuit 16. Further, when the output of the OR gate 18 is inverted from "1" to "0", it is supplied to an ADS buffer 19. Meanwhile, the aforementioned count data read into the ADS buffer 19 is supplied to an input terminal A of the comparator circuit 16. As a result, the comparator circuit 16 executes the comparison of the "on" period of the note specification keys 2-0 to 2-16 and keys 2-28 and 2-29 o(input data to the input terminal A) and "off" period of the keys (input data to the input terminal B). When the "on" period is shorter than or equal to the "off" period (FIG. 4B), the comparison result signal is "0", and when the "on" period is longer than the "off" period it is "1". This signal is supplied as the aforementioned flag data to an area 5B of the buffer 15.

A gate 20 is a gate which is enabled by a gate control signal g provided from the control section 11 at the time of the auto play. At the time of the auto play, flag data and tone duration data progressively read out from the note memory 13 are supplied through the aforementioned gate circuit 20 to a tone duration section 21. The tone duration division section 21 divides the input tone duration data into portions of 1:1 and provides signals E1 and E2 of an equal content when the input flag data is "0". When the input flag data is "1", it divides the input tone duration data into portions of 3:1 and provides signals E2 and E3 in corresponding proportions.

To an envelope control section 22, a signal ONE-KEY due to one-key play key is supplied. This envelope control section 22 forms two different envelope control data with the ratio of the attack, decay and sustain portions ADS of the envelope to the release portion R thereof being 1:1 and 3:1 depending upon the input state of the signal ONE-KEY (i.e., the ratio between the "on" and "off" periods) or upon the contents of the signals E1 and E2 automatically progressively supplied at the time of the auto play. When the envelope control operation is ended, it provides an end signal e which is supplied to the control section 11 to cause the section 11 to execute various operation for the next musical sound.

To a code conversion section 24, 27 note data provided from the control section 11 or 27 note data progressively read out from the note memory 13 at the time of the auto play are supplied when writing note data in the note memory 13 by using the note specification keys or when merely performing a melody. The section converts this note data (1 to 27) into musical sound codes in a predetermined relation to the note data (1 to 27) for supplying them to a tone generating section 23. To the tone generating section 23 a frequency signal related to each octave is also supplied from the aforementioned timing signal generating section. The tone generating section 23 provides analog musical signals of the notes corresponding to the musical code signals from a code converter 24 and envelope-controlled by envelope control data according to the aforementioned frequency signal for supplying it to an amplifier 25.

In a code converter 26, the 27 note data from the control section 11 or note memory 13 is converted into corresponding display data which is displayed on the display section 3. In this case, since the individual notes are made to correspond to respective numeral values 1 to 7 which are pointed on the keyboard section 2A, display of notes on the display section 3 is made by the mark "#" indicating semitone and bar indicative octave.

An end detection circuit 27 is a circuit for detecting end codes read out in the last from the note memory 13 at the time of the auto play. The detection signal FM is supplied to an auto play repetition control section 28. The auto play repetition control section 28 is a circuit for controlling the repetition of performance of melody at the time of the auto play mode mentioned earlier and the aforementioned signals AUTO, C, RST, EM and also numerical value data representing the number of performances as set in the keying section 2 are supplied to it. When the signal AUTO is supplied, it generates a melody start signal ST supplied to the control section 11 for starting the first performance. Then, detection signals EM detected in a section detector 27 before the end of every melody performance are counted, and a detecting operation checking whether the count value coincides with the preset number of performance is executed. Until a coincidence is detected, a performance repeat signal RP is continuously supplied to the control section 11. When the coincidence is detected, the repeat signal RP is discontinued to bring an end to the repeat operation. In this way, a series of operation is executed.

A rhythm pattern memory section 29 is constituted by a ROM (read only memory) for storing rhythm pattern data of various rhythms such as march and waltz. When a rhythm is specified by the operation of the rhythm specification key on the key input section 2, data representing the address of the ROM with respect to the specified rhythm is supplied to the control section 11, and is coupled through a bus line B3 to a rhythm pattern memory section 29. Thus, rhythm pattern data of the specifying rhythm is read out from the rhythm pattern memory section 29 and supplied to a rhythm generating section 30. The rhythm generating section 30 generates a rhythm according to the input rhythm pattern data and provides an analog rhythm signal supplied to the amplifier 25. The amplifier 25 amplifies the musical sound signal and rhythm signal, and its output is supplied to a loudspeaker 31 for producing sound from a loudspeaker 4.

Now, the operation of the above embodiment will be described. In the first place, a case of presetting a melody for one-key play in the note memory 13 and causing one-key play performance will be described. In this case, the mode selection switch 9 is switched from the position to the position REC to turn on power while also setting a recording mode. At this time, when the output signal MD of the mode selection switch is supplied to the control section 11, the reset signal RST is provided to reset the individual circuits to the initial state, and, subsequently, control operation for the recording mode is executed by the control section 11. Further, the read/write control signal R/W for giving a write instruction to the note memory 13 is provided.

Then, the operation of progressively keying note data for the individual notes of a melody to the note memory 13 by operating the note specification keys 2-0 to 2-16 is started. In this case, the "MC" key 2-25 is first operated. At this time, the signal KD is supplied from the keying section 2 to the control section 11, and the control section 11 discriminates the kind of operated key from the signal KD from the control section 11 and provides signal R to the note memory 13 and address counter 14. As a result, the note memory 13 is cleared, and the address counter 14 is reset. Then, if the first note of the melody is A3, for instance, the key 2-16 is turned on to specify this note. As a result, during the "on" state of this key 2-16, the signal KD is supplied to the control section 11 and OR gate 18. The control section 11 provides note data (1) corresponding to the note A3 to be supplied through the buffer 15 to the area 15A of the buffer 15. The output of the OR gate 18, meanwhile, becomes "1" during the "on" state of the key 2-11 as it is supplied to the ADS buffer 19 and tone duration counter 17. Thus, the duration counter 17 executes the operation of counting a predetermined frequency signal during the "on" state of the key 2-16. When the key 2-16 is turned off, the output of the OR gate 18 becomes "0". Thus, the count value data ("on" period) of the tone duration counter 17 at this instant is stored in the ADS buffer 19, and the tone duration counter 17 continues the counting operation until the next key is depressed. When the key 2-0 for the note B3 is turned on, the signal KD is provided again. As a result, the output of the OR gate 18 is supplied to the ADS buffer 19 and the content of the tone duration counter 17 becomes "1" again. In the "on" state of the key 2-0 the count value data for the "on" period of the first note key 2-11 and the count value data representing the total tone duration for the key 2-16 are supplied to the input terminals A and B of the comparator 16. The comparator 16 compares both the input data, and supplies the comparison result signal, which is "0" if the "on" period is shorter than or equal to the "off" period and is "1" if the "on" period is longer than the "off" period, to the area 15B of the buffer 15. Also, in the "on" state of the key 2-0 the total count value data with respect to the key 2-16 is supplied to the area 15C. Thus, the signal RD is provided from the control section 11 at the aforementioned "on" time. When the key 2-0 is turned on, the note data corresponding to the first note A3, flag data (either "0" or "1") and tone duration data are read into the areas 15A, 15B and 15C of the buffer 15 and then in the zero address of the note memory 13. Thereafter, a "+1" signal is provided from the control section 11 to the address counter 14, so that the address "1" is addressed from the next time. Further, when the aforementioned key "0" is turned on, the interval counter 17 is reset to start a counting operation with respect to the key 2-0.

The operation of writing note data with respect to the individual keys after the second note key 2-0 in the note memory 13 is the same as has been executed in the individual operations at the time of turning on and off the first note key 2-16 and turning on the next key. In the case of the second key, when the key of the third note is turned on, the note data of the second note is written together with the flag data and integral data in the address "1" of the note memory 13. In the case of the succeeding third note key, the note data of the third note and other data are written in the address "2" of the note memory when the fourth note key is turned on, and so on. Also, the note data provided from the control section 11 whenever one of the note specification keys 2-0 to 2-16 is turned on, is also supplied to the code converters 24 and 26. Thus, in the code converter 24, the input note data is converted into corresponding musical sound code signals supplied to the tone generating section 23, whereby the musical sound having the note of the operated key is produced from the loudspeaker 31, and the note can be confirmed by the sense of hearing. Also, in the code converter 26, an operation converting the input note data into corresponding display data and supplying this data to the display section 3 is executed. Thus, the display of the notes of the operated keys by numerical figures or the like is made and visually confirmed.

Figure 5A:
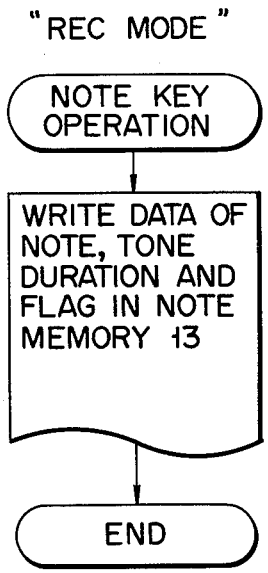
FIGS. 5A and 5B are flow charts illustrating the operation of the apparatus of FIGS. 1 and 2 in one-key play mode.

In the operation described so far, the writing of the note data of melody for one-key play into the note memory 13 is completed. FIG. 5A illustrates this operation.

Now, for starting the melody performance by one-key play by reading out note data written in the note memory 13 in the manner as described above, the mode selection switch 9 is first switched from the position REC to the position PL to set a play mode. As a result, the control section 11 is caused to start a control operation for the play mode.

Then, the "AC" key 2-20 is operated, and at this time, the signal R is produced from the control section 11 to reset the address counter 14, and the address "0" of the note memory 13, which is the leading address, is addressed. Then, the "M+" key 2-28 as the one-key play key or one-key play key 2-29 is operated or both the keys are alternately operated to start the melody performance in the one-key play. For example, when the one-key play key 2-29 is turned on first, the signal ONE-KEY (of "1") is provided from the keying section 2 and supplied to the OR gate 18 and envelope control section 22. Meanwhile, the note data 1 of the first mode is read out from the address "0" of the note memory 13 and supplied to the code converter 24. Thus, a musical sound code signal corresponding to the note data 1 is supplied to the tone generating section 23. During the presence of the signal ONE-KEY of "1", the envelope control section 22 produces envelope control data for controlling the ADS (attack, decay, sustain) portions of the envelope and supplies it to the musical sound generating section 23. Thus, during the "on" state of the one-key play key 2-29 the musical sound generating section 23 produces a musical signal, in which the ADS portions of envelope are given to the note A3 of the note code 1, and supplies it to the amplifier 25, whereby musical sound of the note A3 is produced from the loudspeaker 31.

When the one-key play key 2-29 is turned off, the signal ONE-KEY becomes "0". As a result, the envelope control section 22 produces envelope control data for controlling the R (release) portion of the envelope and supplies it to the musical sound generating section 23, whereby the musical sound of the aforementioned note A3 is gradually attenuated and vanishes. Further, when the one-key play key 2-29 is turned off, the address counter 14 is incremented by "+1" to address the address "1".

While the "M+" key 2-28, subsequently, is turned on the signal ONE-KEY of "1" is provided again to the envelope control section 22. Thus, during the "on" state of the aforementioned key 2-28, the envelope control section 22 produces envelope control data for controlling the ADS portions of the envelope. Meanwhile, the note data 3 (of the note B3) read out as the second note from the note memory 13 is supplied to the conversion section 24, whereby the musical sound of the note B3 is produced. Also, when the "M+" key 2-28 is turned off, the signal ONE-KEY becomes "0", and the musical sound of the note B3 is attenuated and vanishes.

Figure 5B:
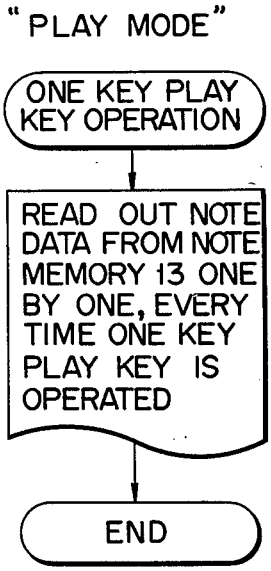

Thereafter, the note data is similarly read out from the note memory 13 every time one of the aforementioned one-key play key is turned on, and also the address counter is incremented by "+1" every time the key is turned off, whereby the melody performance due to one-key is executed. FIG. 5B illustrates the operation described above.

Figure 6A:
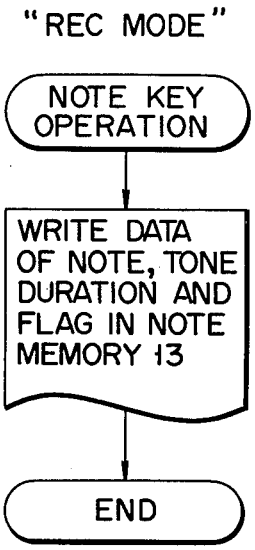
FIGS. 6A, 6B and 6C are flow charts illustrating the operation of the apparatus of FIGS. 1 and 2 in an auto play mode.

Now, the operation in case of executing melody performance by auto play after presetting the melody for auto play in the note memory 13 will be described. In this case, the note data is first written in the note memory 13. This writing operation is executed in the same way as the operation of writing the melody for one-key play in the note memory 13 as mentioned. More particularly, the note data, flag data and tone duration data are written in the note memory 13 while performing the melody by operating note specification keys. When presetting the melody for auto play, one of the keys 2-20, 2-28 and 2-29 is operated after the melody, and a section code is written at the end of the melody written in the note memory 13. FIG. 6A illustrates the aforementioned operation.

Then, for writing accurate flag data and tone duration data for auto play in the note memory 13, the mode selection switch 9 is continually held at the position REC, and the record mode is set, while generating a rhythm. The melody performance by one-key play is effected in accordance with this rhythm. In this case, the key 2-20 is operated to reset the address counter 14, and the address "0" of the note memory 13 is addressed. Then, if the rhythm is the march, the march rhythm is specified by the keys 2-22 and 2-1. At this time, address data with respect to the area for storing the rhythm pattern of march is provided from the control section 13 to a rhythm pattern memory section 29. Then, the rhythm pattern of the march starts to be read out from the rhythm pattern memory section 29 and supplied to the rhythm generating section 30. Thus, march starts to be produced from the loudspeaker 31.

Then, melody performance of one-key play as mentioned earlier is accurately executed according to the rhythm being produced by using the key 2-28 for one-key play or one-key play key 2-29. The melody performed in this case is stored in the note memory 13 in advance. When the key 2-28 is first turned on, the signal ONE-KEY of "1" is output and supplied to the OR gate 18 and envelope control section 22. Also, the note data 1 of the first note is read out from the address "0" of the note memory 13 and supplied to the area **15*a* of the buffer 15 and code conversion sections 24 and 26. Thus, during the "on" state of the key 2-28, the musical sound of the note A3 is produced with the envelope ADS portions and sounded. During this time, the tone duration counter 17 counts the "on" period with respect to the note A3 (note data 1). When the key 2-28 is turned off, the signal ONE-KEY becomes "0". As a result, the envelope control section 22 starts to produce the release portion, while the "on" period of the tone duration counter 17 is taken into the ADS buffer 19. The tone duration counter 17 then continues the time counting operation. Subsequently, when the one-key play key 2-29 is turned on, the signal ONE-KEY is changed to "1". At this time, the address counter 14 is changed to "+1", and the address "1" is subsequently addressed. Further, when the key 2-5 is turned on, the "on" period of the note A3 as the first note and the total tone duration are compared in the comparator 16, and the comparison result data, which is "0" if the "on" period is shorter or equal to the "off" period and is "1" if the "on" period is longer than the "off" period as mentioned above, is provided and supplied as flag data to the area 15A of the buffer 15. Further, the total tone duration data is supplied to the area 15C, and thus at the time of the key-on of the key 2-5 the note data 1, flag data (of either "0" or "1") and tone duration data are written through the buffer 15 into the address "0" of the note memory 13**. Further, at this time the written flag data and tone duration data are both accurate musical sound data desired by the player.

Figure 6B:
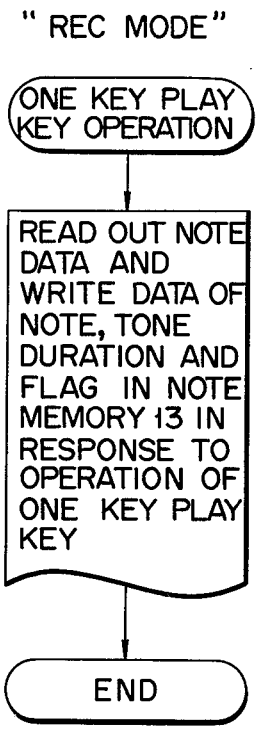

The tone duration counter 17 is reset when the one-key play key 2-29 is turned on to start the counting of the "on" period with respect to the musical sound of the second note, and the ADS portions of the musical sound of the note B3 as the second note is produced from the loudspeaker 31. The subsequent melody performance operation of one-key play is the same as described earlier. More particularly, every time the one-key play key is turned on, new note data is read out from the note memory 13 to start production of the accurate flag data and tone duration data and tone duration data produced at the time of the operation of the next one-key play key are written together with the relevant note data in the original address area of the note memory 13. When the melody performance is ended, the section code is written again in the note memory 13 with the aforementioned keying operation. With the above operation, the operation of writing the flag data and tone duration data of the auto play is ended. FIG. 6B illustrates the operation described above.

Then, when obtaining the auto play melody performance only once, the mode selection switch 9 is switched to the position PL to set the play mode. Then, the keys 2-20 and 2-27 are continuously operated. At this time, the signal AUTO (of "1") is provided as the auto play start instruction and supplied to the control section 11 and auto play repetition control section 28. Also, the address counter 14 is reset, and the address "0" of the note memory 13 is addressed. In this state, the auto play repetition control section 28, subsequently, executes the operation of executing the melody performance only once, that is, it provides the melody start signal ST only once to the control section 11 at the time of the appearance of the aforementioned signal AUTO, and does not provide any repeat signal RP.

After the appearance of the aforementioned melody start signal, the control section 11 provides the "+1" signal for every appearance of the end signal e from the envelope control section 22, i.e., at the end of the production of every musical sound. Thus, sets of note data and flag data for the respective notes (i.e., musical sounds) are successively read out from the note memory 13. In this case, the note data read out is supplied to the code converters 24 and 26 and end detecting section 27 and subjected to the aforementioned various processes. Further, at the time of the auto play the gate circuit 20 is held "on" by the gate control signal g of "1" provided from the control section 11, and the flag data and the tone duration data read out from the note memory 13 are thus supplied through the gate circuit 20 to the tone duration division section 21. The tone duration division section 21 divides the tone duration data such that the ADS and R portions of the envelope are equal when the flag data is "0", signals E1 and E2 of an equal content being this time obtained and supplied to the envelope control section 22, while when the input flag data is "1" it divides the interval data such that the aforementioned ADS and R sections are 3:1 to provide the corresponding signals E1 and E2 to the envelope control section 22. Thus, in the former case a musical sound where the ADS and R portions are equal is produced, while in the latter case a musical sound where the ADS section is three times the R section is produced.

Figure 6C:
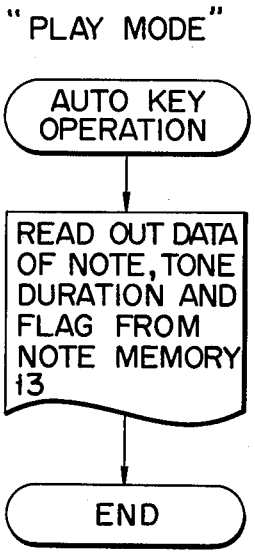

The melody performance by the auto play is executed in the manner as described above. When the melody performance is ended, the end code is detected by the end detecting section 27, which thus divides the signal EM (of "1") to the auto play repetition control section 28, whereupon the auto play operation is completely ended. FIG. 6C illustrates the aforementioned operation.

When repeatedly obtaining the auto play melody performance four times, the keys 2-4, 2-21 and 2-27 are operated after the setting of the play or performance mode. With this keying operation, "4" is set as the number of performances in the auto play repetition control section 28, and also the address counter 14 is reset to start performance of melody. The melody performance is executed in the operation similar to that in the aforementioned case of auto play for one time. The signal EM provided from the section detector 27 is counted by the auto play repetition control section 28 at the end of the every melody performance. Until the count value coincides with the preset number "4", the auto play repetition section 28 continues to provide the repeat signal RP (of "1") to the control section 11 to continue the melody performance. When the melody performance is completed for four times, the coincidence of the aforementioned count value and the preset number "4" is detected in the auto play repetition control section 28 and, as a result, the repeat signal RP becomes "0". Thus, the control section 11 stops the generation of the "+1" signal, thus bringing an end to the melody performance repeating operation.

While in the above embodiment only a single piece of music can be stored as melody in the note memory 13, it is of course possible to permit storage of a plurality of pieces of music. In this case, it may be arranged such that an end code is necessarily written in at the end of the piece, and in the repeat performance a series of music pieces may be repeatedly performed for a plurality of times, or only a specified piece may be performed a plurality of times. Further, while in the above embodiment the ratio of the ADS portion of the envelope to the R portion thereof is set to 1:1 or 3:1, this is by no means limitative. Further while the above embodiment has concerned a small size electronic computor having a musical sound generating function, the invention is of course applicable to various other small size electronic apparatus.

As has been described in the foregoing, according to the invention a note memory capable of writing and reading sets of note data and tone duration data for auto play as well as note data of one-key play is provided and note data for the auto play is produced and written in the note memory when effecting melody performance by progressively reading out note data for one-key play from the note memory, so that it is possible to extremely simplify the method of keying the sets of note data and tone duration data for the auto play and also the method of keying the note data for the one-key play compared to the prior art. In addition, since the note memory can be used for both one-key play and auto play, a high efficiency of use of memory can be obtained.

Further, since a tone information memory system is used, in which data about the "on" and "off" periods of the note keys are stored in the form of the data represented by the ratio of the two, it is possible to generate musical sound having rich tone character with a very small storage capacity.

What is claimed is:

1. An electronic apparatus having a tone generating function, comprising:

input means for inputting note data;

memory means for storing the note data input by operation of said input means;

a readout key which is provided independently from said input means and which is operable for reading out the note data from said memory means sequentially one by one every time the readout key is operated, after said note data is stored in said memory means by said input means;

first detecting means for detecting a key-on period during which said readout key is kept operated;

second detecting means for detecting a key-off period during which said readout key is not operated;

duration input means coupled to said first and second detecting means for inputting tone duration information into said memory means, said input tone duration information designating tone producing intervals and tone releasing intervals according to the key-on period and the key-off period, respectively, with respect to each input note data.

2. The electronic apparatus of claim 1, wherein said duration input means includes:

means for calculating a ratio of the key-off period to the total duration of the key-on and key-off periods; and means for inputting the calculated ratio and said total duration as the tone duration information into said memory means.

3. The electronic apparatus of claim 1, further comprising automatic performance means for reading the note data and duration information from said memory means and for producing musical sound.

4. The electronic apparatus of claim 3, wherein said automatic performance means includes means for designating the number of times the automatic performance is to be repeated.

5. The electronic apparatus of claim 1, wherein said readout key is a depressible key; and wherein said first detecting means detects said key-on period during which said readout key is kept depressed, and said second detecting means detects said key-off period during which said readout key is not kept depressed.

6. The electronic apparatus of claim 5, wherein said depressible readout key is a manually depressible readout key.

7. The electronic apparatus of claim 1, wherein said readout key is a manually depressible readout key which is manually depressible for reading out said note data; and wherein said first detecting means detects said key-on period during which said read-on key is kept manually depressed, and said second detecting means detects said key-off period during which said readout key is not depressed.

8. The electronic apparatus of claim 1, wherein said readout key is a single manually operable readout key.

9. An electronic apparatus having a tone generating function, comprising:

mode setting means for setting the electronic apparatus to an arithmetic operation mode and to a music mode;

input means including numeric keys and function keys for inputting note data in said music mode and for designating a number and four arithmetic operations in said arithmetic operation mode;

memory means for storing the note data input by operation of said input means in said music mode;

a readout key which is provided independently of said input means and which is operable for reading out the note data from said memory means sequentially one by one every time the readout key is operated in said music mode, after said note data is stored in said memory means by said input means;

first detecting means for detecting a key-on period during which said readout key is kept operated in said music mode;

second detecting means for detecting a key-off period during which said readout key is not operated in said music mode;

duration input means coupled to said first and second detecting means for inputting tone duration information into said memory means, said input tone duration information designating tone producing intervals and tone releasing intervals according to the key-on period and the key-off period, respectively, with respect to each input note data, in said music mode; and operating means for performing arithmetic operations designated by the operation of said function keys in said arithmetic operation mode.

* * * * *